US007164271B2

(12) United States Patent
Ando

(10) Patent No.: US 7,164,271 B2
(45) Date of Patent: Jan. 16, 2007

(54) ION CURRENT DETECTING DEVICE IN INTERNAL COMBUSTION ENGINE

(75) Inventor: Koji Ando, Motosu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/331,025

(22) Filed: Jan. 13, 2006

(65) Prior Publication Data

US 2006/0158195 A1 Jul. 20, 2006

(30) Foreign Application Priority Data

Jan. 14, 2005 (JP) ..... 2005-007464
Sep. 20, 2005 (JP) ..... 2005-271952

(51) Int. Cl.
*F02P 17/00* (2006.01)

(52) U.S. Cl. ..... 324/380

(58) Field of Classification Search ..... None
See application file for complete search history.

(56) References Cited

U.S. PATENT DOCUMENTS 5,959,192 A * 9/1999 Mogi et al. ..... 73/35.08
6,011,397 A * 1/2000 Yasuda ..... 324/388
6,202,474 B1 * 3/2001 Takahashi et al. ..... 73/35.08

FOREIGN PATENT DOCUMENTS

JP 11-13520 1/1999

* cited by examiner

*Primary Examiner*—Vincent Q. Nguyen
(74) *Attorney, Agent, or Firm*—Nixon & Vanderhye, P.C.

(57) ABSTRACT

An ion current detecting device includes an ion current detecting unit which detects ion current based on combustion ion generated after an ignition which is performed in a combustion chamber and an amplifier unit which amplifies ion current detected by the ion current detecting unit. The amplifier unit has an amplification rate which is set so that an output amplified ion current varies nonlinearly with ion current of the ion current detecting unit. Thus, the amplifier unit enables the amplification rate to vary according to a level of ion current. Therefore, ion current can be detected correctly even if a minute ion current is generated when the spark plug malfunctions etc., and even if ion current becomes higher.

6 Claims, 7 Drawing Sheets

ION CURRENT DETECTING DEVICE IN INTERNAL COMBUSTION ENGINE

CROSS REFERENCE TO RELATED APPLICATION

This application is based on and incorporates herein by reference Japanese Patent Application No. 2005-7464 filed on Jan. 14, 2005 and No. 2005-271952 filed on Sep. 20, 2005.

1. Technological Field

Example embodiments of the present technology described herein relate to an ion current detecting device for detecting a combustion condition (e.g., spark or misfire) by detecting ion current based on a combustion ion generated when an ignition is performed in an combustion chamber of an internal combustion engine.

2. Description of Related Art

As disclosed in JP-A-11-13520, an ion current detecting device in an ignition apparatus of an internal combustion engine is devised in order to detect a combustion condition such as a spark or a misfire.

FIG. 8 is a circuit diagram of an ion current detecting device of prior art. As shown in FIG. 8, an ion current detecting device J20 is connected to a secondary coil J2*b* of an ignition coil J2 which is connected to a gap J1 between electrodes of an spark plug. This ion current detecting device J20 detects the combustion condition (spark or misfire) by detecting ion current which flows through the secondary coil J2*b* when a combustion ion is generated at the gap J1 by a performance of an ignition in a combustion chamber of an internal combustion engine.

The ion current detecting device J20*a* includes Zener diodes J3 and J4, a capacitor J5, an amplifier circuit J9, a V-I converting circuit J13, and an input protection resistance J14. The Zener diode J3 is connected in series with the secondary coil J2*b*. The Zener diode J3 suppresses unwanted ignition of an air-fuel mixture in the cylinder when a primary coil J2*a* is turned on. The Zener diode J4 is connected in parallel with the capacitor J5. The Zener diode J4 and the capacitor J5 are connected in series with the secondary coil J2*b*. The amplifier circuit J9 is connected to a junction among the capacitor J5 and the Zener diodes J3 and J4. The amplifier circuit J9 includes an operational amplifier J6 and resistances J7 and J8. An output terminal of the amplifier circuit J9 is connected to the V-I converting circuit J13. The V-I converting circuit J13 includes an operational amplifier J10, an npn transistor J11, and a resistance J12. A collector of the npn transistor J11 of the V-I converting circuit J13 is connected to the input protection resistance J14.

An electric controlling unit (ECU) J16 is connected to the input protection resistance J14. The ECU J16 has a current detection resistance J15 and a supply battery Vcc. A current converted by the V-I converting circuit J13 is detected by the ECU J16 so that ion current can be detected.

When a current flows through the primary coil J2*a* of the ignition coil J2 and a voltage between two ends of the primary coil J2*a* becomes a predetermined voltage v1, a voltage between two ends of the secondary coil J2*b* becomes a predetermined voltage v2 according to a coil ratio of a number of turns of the secondary coil J2*b* to the primary coil J2*a* by a trans effect. Thus, an ignition is performed by a discharge at the gap J1 of the spark plug.

The current flows through the secondary coil J2*b*, the Zener diodes J4 and J3 as described by a path (1) in FIG. 8. The capacitor J5 is charged because of a voltage generated between both ends of the Zener diode J4.

Moreover, since the capacitor J5 is be charged at the time the current of the secondary coil J2*b* is stopped as well as a magnetic energy stored in the secondary coil J2*b* is lost, a potential difference between both ends of the capacitor J5 is occurred. For this reason, when an electrical potential of an inverting input terminal of the operational amplifier J6 becomes an electrical potential of the non-inverting input terminal of the operational amplifier J6, i.e., ground potential (GND), the capacitor J5 plays a role of a power supply for ion current. Thus, ion current flows by the combustion ion generated by a combustion in the cylinder at the gap J1 as described by a path (2) in FIG. 8.

On the other hand, when ion current flows, a current flows into the inverting input terminal of the operational amplifier J6 from the output terminal of the operational amplifier J6 through the resistance J8 as described by a path (3) in FIG. 8. For this reason, an output current amplified ion current by an amplification rate of the amplifier circuit J9 is produced from the output terminal of an operational amplifier J6. A potential change of the output terminal of an operational amplifier J6 caused by the output current affects a non-inverting input terminal of the operational amplifier J10 of the V-I converting circuit J13. Thus, a collector current flows via the npn transistor J11 according to a potential inputted to the non-inverting input terminal of the operational amplifier J10. Therefore, a current value through the current detection resistance J15 changes, so that the current value which flows through the current detection resistance J15 is detected as a detected current value according to ion current by the ECU J16.

An ion current value of the internal combustion engine is sharply changed according to an engine revolution speed, an accelerator pedal position, an environmental condition, a malfunction of the spark plug (for example, fouling of electrodes of the spark plug), etc. The peak value of the ion current value varies, for example in the range of several micro-amperes to hundreds of micro-amperes.

However, the ion current detecting circuit in the prior art generates an output ion current which is a linearly amplified ion current by the amplifier circuit J9. That is, an amplification rate of the amplifier circuit J9 is constant relative to ion current into the ion current detecting circuit J20. If the amplification rate is set to be able to detect a minute ion current value generated when the spark plug malfunctions (for example, the electrodes of the spark plug foul), the maximum detectable ion current level becomes lower (for example, 20 micro-amperes (20 mA) ). Thus, if an ion current value inputted into the ion current detecting device J20 is beyond a low predetermined ion current level, the amplifier circuit J9 can only generate the maximum detectable ion current level (for example, 20 mA).

Accordingly, if ion current which actually flows through the gap J1 is for example, 100 micro ampere (100 mA), there is a possibility that ion current cannot be detected correctly and the combustion condition cannot be evaluated correctly in the ECU J16.

Therefore, it would be desirable to provide a wide ion current detection range, so that ion current can be detected correctly even if a minute ion current is generated when the spark plug malfunctions etc., and even if the ion current becomes higher.

SUMMARY OF NON-LIMITING EXAMPLE EMBODIMENTS OF THE INVENTION

Example embodiments of present invention resolve the foregoing desire and other problems. Accordingly, one aspect of Example embodiments of the present invention is to provide an ion current detecting device that can detect ion current correctly even if a minute ion current is generated when the spark plug malfunctions etc., and even if ion current becomes higher. The ion current detecting device thus correctly detects an ion current over a wide range.

According to one aspect of example embodiments of the present invention, an ion current detecting device includes an ion current detecting unit which detects an ion current based on combustion ions generated after an ignition which is performed in a combustion chamber and an amplifier unit which amplifies the ion current of the ion current detecting unit. The amplifier unit has an amplification rate which is set so that an amplified ion current varies output by the amplifier unit nonlinearly with ion current detected by the ion current detecting unit. Thus, the amplifier unit enables the amplification rate to vary according to a level of ion current. Therefore, an ion current can be detected correctly even if a minute ion current is generated when a spark plug malfunctions etc. (for example, electrodes of the spark plug fouls) and even if ion current becomes higher.

According to another aspect of example embodiments of the present invention, the amplifier unit sets a second amplification rate so that is smaller than a first amplification rate (the first amplification rate being used for lower ion current level and the second amplification rate being used for higher ion current level). Thus, when a minute ion current is generated due to a spark plug malfunction, the minute ion current can be detected using the first amplification rate. On the other hand, when higher ion current is generated, ion current can be detected using the second amplification rate which is smaller than the first amplification rate. Therefore, ion current can be detected correctly even if a minute ion current is generated when the spark plug malfunctions etc., and even if ion current becomes higher.

BRIEF DESCRIPTION OF THE DRAWINGS

The present invention will be understood more fully from the detailed description given hereinafter and from the accompanying drawings of the example embodiments of the invention, which, however, should not be taken to limit the invention to the specific embodiments but are for the purpose of explanation and understanding only.

In the accompanying drawings:

FIG. 8 is a circuit diagram of an ion current detecting device of prior art.

DETAILED DESCRIPTION OF NON-LIMITING EXAMPLE EMBODIMENTS

Hereafter, example embodiments of the present invention of an ion current detecting device will be described in detail by referring to the accompanying drawings.

Figure 1:
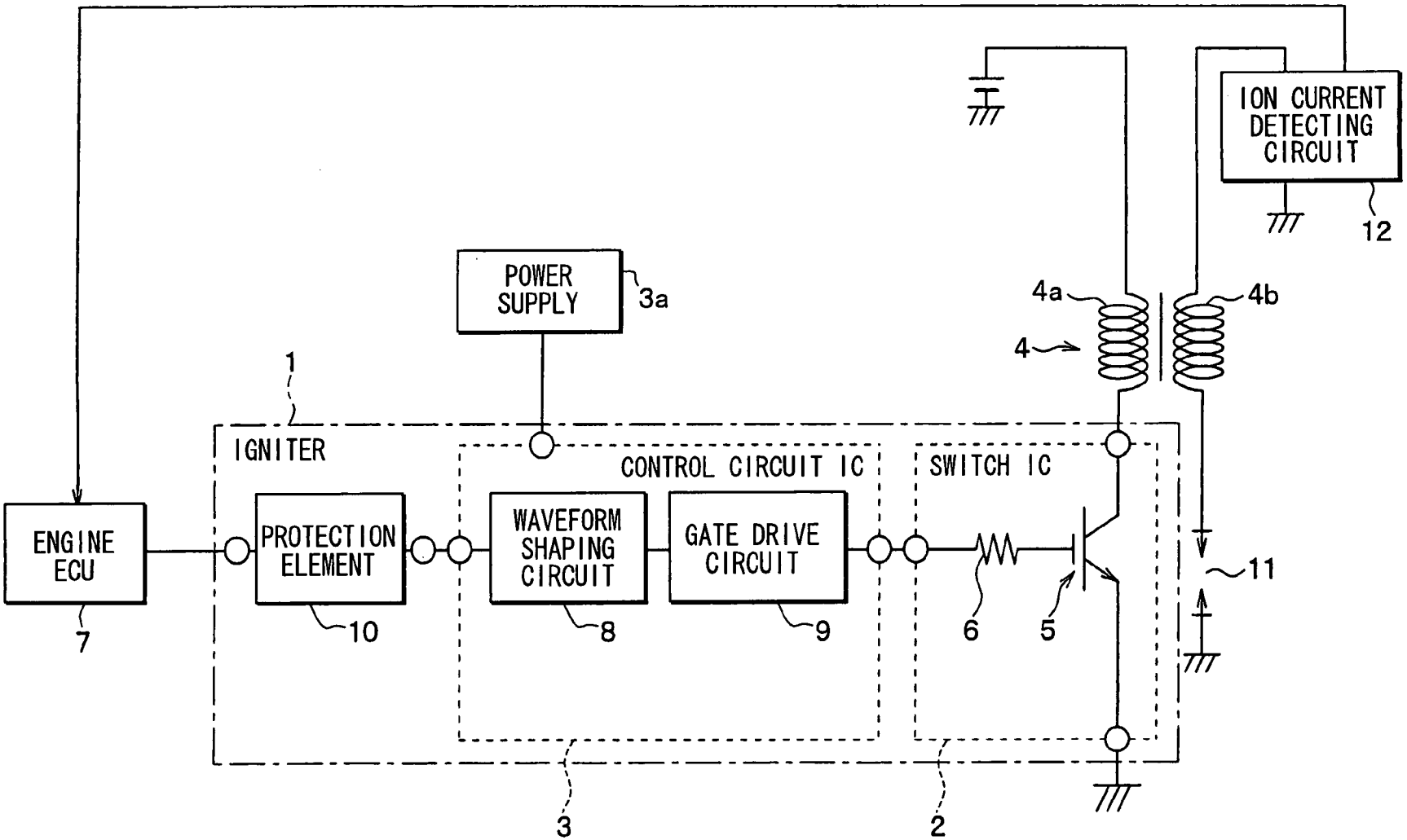
FIG. 1 is an outline block diagram of an ignition apparatus with an ion current detecting device according to first example embodiment of the invention.

FIG. 1 is an outline block diagram of an ignition apparatus with an ion current detecting device for an ignition apparatus of a vehicle.

As shown in FIG. 1, the ignition apparatus for the vehicle includes an igniter 1. This igniter 1 includes a switch IC 2 and a control circuit IC 3.

The igniter 1 operates a switching control of a turning on of an electricity to a primary coil 4*a* of an ignition coil 4. This switch IC 2 includes an IGBT 5 and resistance 6, etc.

A gate voltage is supplied to the IGBT 5 by a control signal from the control circuit IC 3 inputted through the resistance 6. When a potential level of the gate voltage to the IGBT 5 becomes a high level, the IGBT 5 turns on, so that electricity to the primary coil 4*a* of the ignition coil 4 is turned on. When the potential level of the gate voltage becomes a low level, the IGBT 5 turns off, so that the turning on of electricity to the primary coil 4*a* of the ignition coil 4 is stopped.

The resistance 6 is a resistance for providing input protection to protect the IGBT 5.

On the other hand, the control circuit IC 3 receives an ignition signal from an engine electrical control unit (engine ECU) 7 as a control signal and sends the control signal to the IGBT 5 of the switch IC 2. The control circuit IC 3 is supplied electric power from a power supply 3*a*, so that the control circuit IC 3 is driven by the electric power from the power supply 3*a*.

This control circuit IC 3 includes a waveform shaping circuit 8 and a gate drive circuit 9. The ignition signal from the engine ECU 7 inputted into the control circuit IC 3 is waveform shaped at the waveform shaping circuit 8 and is changed into the gate voltage for performing an ON-OFF drive of IGBT 5 by the gate drive circuit 9. For this reason, the ON-OFF drive of IGBT 5 is performed according to the gate voltage supplied from the gate drive circuit 9.

Furthermore, one end of a protection element 10 is connected to an input terminal of the igniter 1 connected to the engine ECU 7. The other end of the protection element 10 is connected to an input terminal of the control circuit IC 3. This protection element 10 can absorb a high frequency surge from the input terminal of the igniter 1.

The primary coil 4*a* of the ignition coil 4 is connected to a collector terminal of IGBT5 of the switch IC 2. A secondary coil 4*b* of the ignition coil 4 is connected to a gap 11 between electrodes of the spark plug. The igniter 1 controls an ignition timing at the gap 11 of the spark plug.

The igniter 1 generates a signal which makes the IGBT 5 turn on from the gate drive circuit 9 through the protection element 10 and the waveform shaping circuit 8 when the ignition signal from the engine ECU 7 becomes a high level.

The IGBT 5 becomes an ON state when supplied with a high gate voltage through the control circuit IC 3 and the resistance 6. A current flows between a collector and an emitter of the IGBT 5, so that a coil current passed through the primary coil 4*a* of the ignition coil 4 increases and a magnetic energy is stored in the ignition coil 4. When the ignition signal from the engine ECU 7 becomes a low level, the IGBT 5 is rapidly turned off by a low level signal of the gate drive circuit 9 through the protection element 10 and the waveform shaping circuit 8 and the magnetic energy stored in the ignition coil 4 is discharged as a discharge current to the gap 11 from the secondary coil 4*b*. An ignition in the internal combustion engine is thus performed at the gap 11 of the spark plug.

Moreover, an ion current detecting circuit 12 is connected to the secondary coil 4*b* of the ignition coil 4 and the engine ECU 7. The engine ECU 7 can detect a detection signal of the ion current (i.e. a current value according to ion current) using an ion current detecting circuit 12. The engine ECU 7 evaluates the combustion state according to a result of the detection signal.

Figure 2:
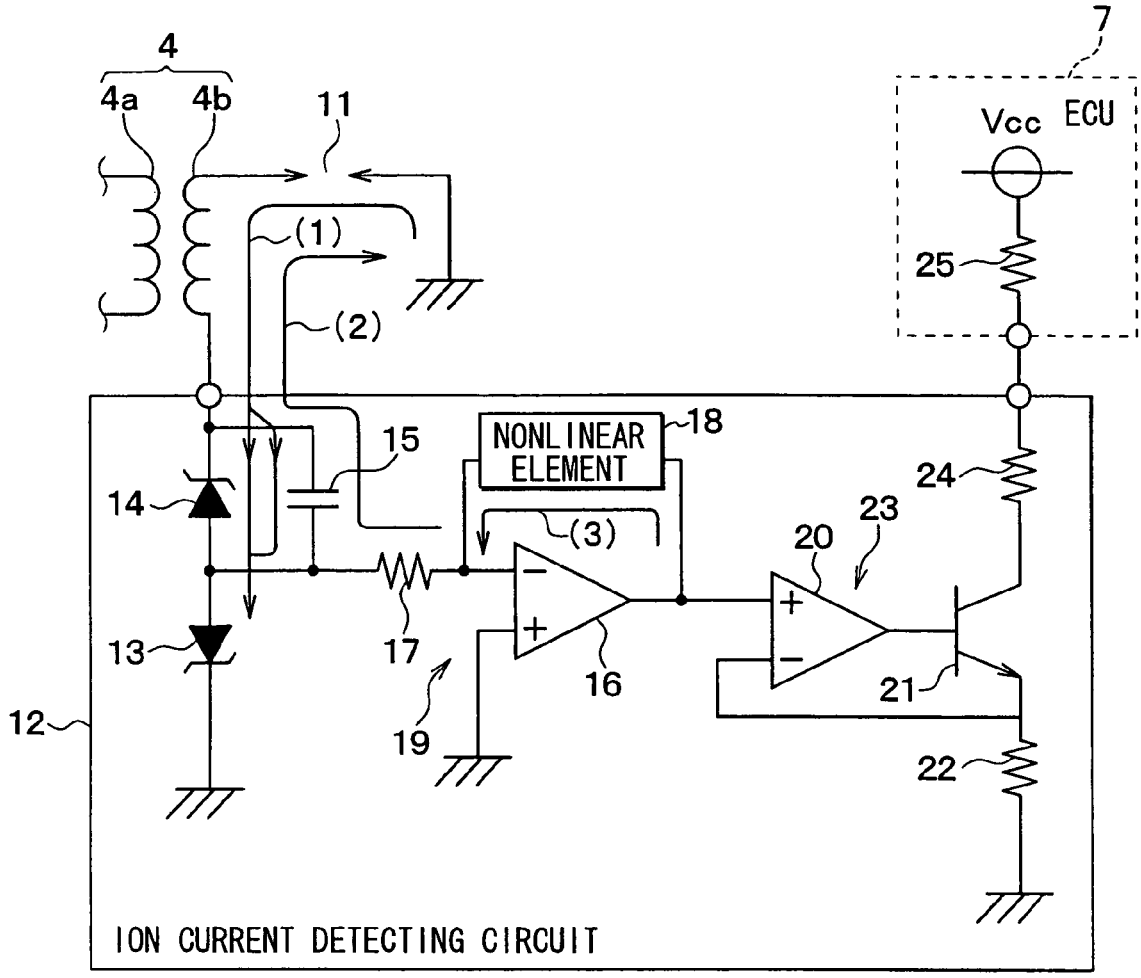
FIG. 2 is a circuit diagram of the ion current detecting device of FIG. 1.

FIG. 2 shows a circuit diagram of the ion current detecting circuit 12. When a spark is generated at the gap 11 of the spark plug by means of a discharge by the igniter 1, a fuel between the gaps 11 burns. Ion current flows through the secondary coil 4*b* when combustion ions generated by combustion between the gap 11 and then a voltage are supplied to the gap 11. The ion current is detected by the ion current detecting circuit 12.

As shown in FIG. 2, the ion current detecting circuit 12 includes Zener diodes 13 and 14, a capacitor 15, an amplifier circuit 19, a V-I converting circuit 23, and an input protection resistance 24. The Zener diode 13 is connected in series with the secondary coil 4*b* of the ignition coil 4. The Zener diode 13 suppresses unwanted ignition of an air-fuel mixture in the cylinder when the primary coil 4*a* of the ignition coil 4 is turned on. The Zener diode 14 is connected in parallel with the capacitor 15. The Zener diode 14 and the capacitor 15 are connected in series with the secondary coil 4*b* and the Zener diode 13.

The amplifier circuit 19 is connected to a junction among the capacitor 15 and the Zener diodes 13 and 14. The amplifier circuit 19 includes an operational amplifier 16, a resistance 17, and a nonlinear element 18 as a feedback element of the operational amplifier 16. That is, the nonlinear element 18 is connected between an output terminal of the operational amplifier 16 and a non-inverting input terminal of the operational amplifier 16 instead of a feedback resistance in the prior art. An inverting input terminal of the operational amplifier 16 is connected to ground. The non-inverting input terminal of the operational amplifier 16 is connected to a junction between the capacitor 15 and the Zener diode 14 through the resistance 17.

The output terminal of the operational amplifier 16 of the amplifier circuit 19 is connected to the V-I converting circuit 23. The V-I converting circuit 23 includes an operational amplifier 20, an npn transistor 21, and a resistance 22. A collector of the npn transistor 21 of the V-I converting circuit 23 is connected to the input protection resistance 24.

The engine ECU 7 is connected to the input protection resistance 24. The engine ECU 7 includes a current detection resistance 25 and a supply battery Vcc. A current converted by the V-I converting circuit 23 is detected by the engine ECU 7 so that the ion current can be detected.

Figure 3:
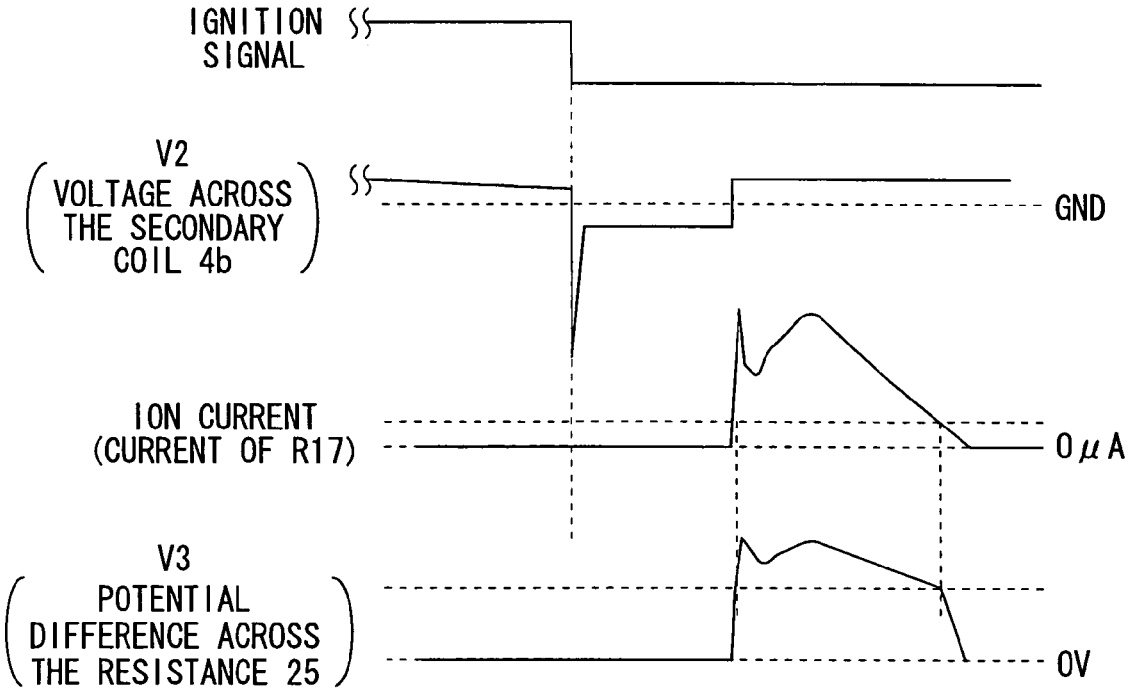
FIG. 3 is a figure showing a voltage and a current wave form of the ion current detecting device of FIG. 2.

The voltage and the current waveform of each part of the ion current detecting circuit 12 is shown in FIG. 3. A detection procedure of ion current is explained based on FIG. 3.

First, as shown in FIG. 3, a current flows through the primary coil 4*a* of the ignition coil 4 based on the ignition signal, and a magnetic energy is stored in the ignition coil 4. The magnetic energy stored in the ignition coil 4 is discharged at the gap 11 as a discharge current from the secondary coil 4*b* by intercepting the current of primary coil 4*a* rapidly, so that ignition is performed and a combustion is generated in the cylinder.

At this time, a current flows through the secondary coil 4*b* as described by a path (1) in FIG. 2. The current flows the Zener diode 14 and the Zener diode 13 for a spark prevention at the time of turning on of the primary coil 4*a*. The capacitor 15 is thus charged since a potential difference is generated between both ends of the Zener diode 14.

Moreover, when the magnetic energy stored in the ignition coil 4 is lost, the flow of the current in the secondary coil 4*b* stops. However, since the capacitor 15 is charged at this time, a potential difference is generated between both ends of the capacitor 15. For this reason, when an electrical potential of an inverting input terminal of the operational amplifier 16 becomes an electrical potential of the non-inverting input terminal of the operational amplifier 16, i.e., ground potential (GND), the capacitor 15 plays a role of power supply for ion current. Thus, the ion current flows by combustion ions generated by a combustion in the cylinder at the gap 11 as described by a path (2) in FIG. 2.

On the other hand, a current flows to the inverting input terminal from the output terminal of the operational amplifier 16 through the nonlinear element 18 as described by a path (3) in FIG. 2 at the same time ion current flows. For this reason, an output current by which ion current is amplified by an amplification rate of the amplifier circuit 19 is generated from the output terminal of the operational amplifier 16. A potential change of the output terminal caused by the output current is thus inputted to the non-inverting input terminal of the operational amplifier 20 in the V-I converting circuit 23. Thus, a collector current flows via the npn transistor 21 according to a potential inputted to the non-inverting input terminal of the operational amplifier 20. Since this collector current is equivalent to an ion output current and this collector current flows also to the current detection resistance 25, a value of the current is detected as a current value according to ion current by the ECU 26.

At this time, the amplification rate of the amplifier circuit 19 is determined by the nonlinear element 18. That is, the amplification rate is determined by a potential difference between both ends of the nonlinear element 18.

In the example embodiment, this nonlinear element 18 functions so that the amplification rate becomes larger when the ion current is lower, and the amplification rate becomes smaller when the ion current is higher.

The amplification rate of the amplifier circuit 19 is determined by a circuit constant (value of resistance) of the resistance 17 and the nonlinear element 18. Since the nonlinear element 18 is used, the amplification rate of the amplifier circuit 19 can vary nonlinearly relative to ion current inputted into the ion detecting circuit 12. That is, an amplified ion current (the output ion current) by the amplifier circuit 19 becomes nonlinear with respect to the ion current inputted into the ion current detecting circuit 12. As shown in FIG. 3, when ion current flows, the collector current of the npn transistor 21 in the I-V conversion circuit 23 changes, and a potential difference V3 between both ends of the current detection resistance 25 in the ECU 7 also changes according to the ion current. The potential difference V3 becomes higher because the collector current fully amplified flows even if the ion current is lower. On the other hand, the potential difference V3 becomes comparatively lower because of the collector current relatively amplified smaller, when the ion current is higher.

The amplification rate of above nonlinear element 18 can be variable according to the detected ion current. Therefore, if a minute ion current can be detected by using a larger amplification rate even when the spark plug malfunctions (for example, when the spark plug fouls). Further, a higher ion current can correctly detected because the amplification rate becomes smaller when the ion current becomes higher.

Figure 4:
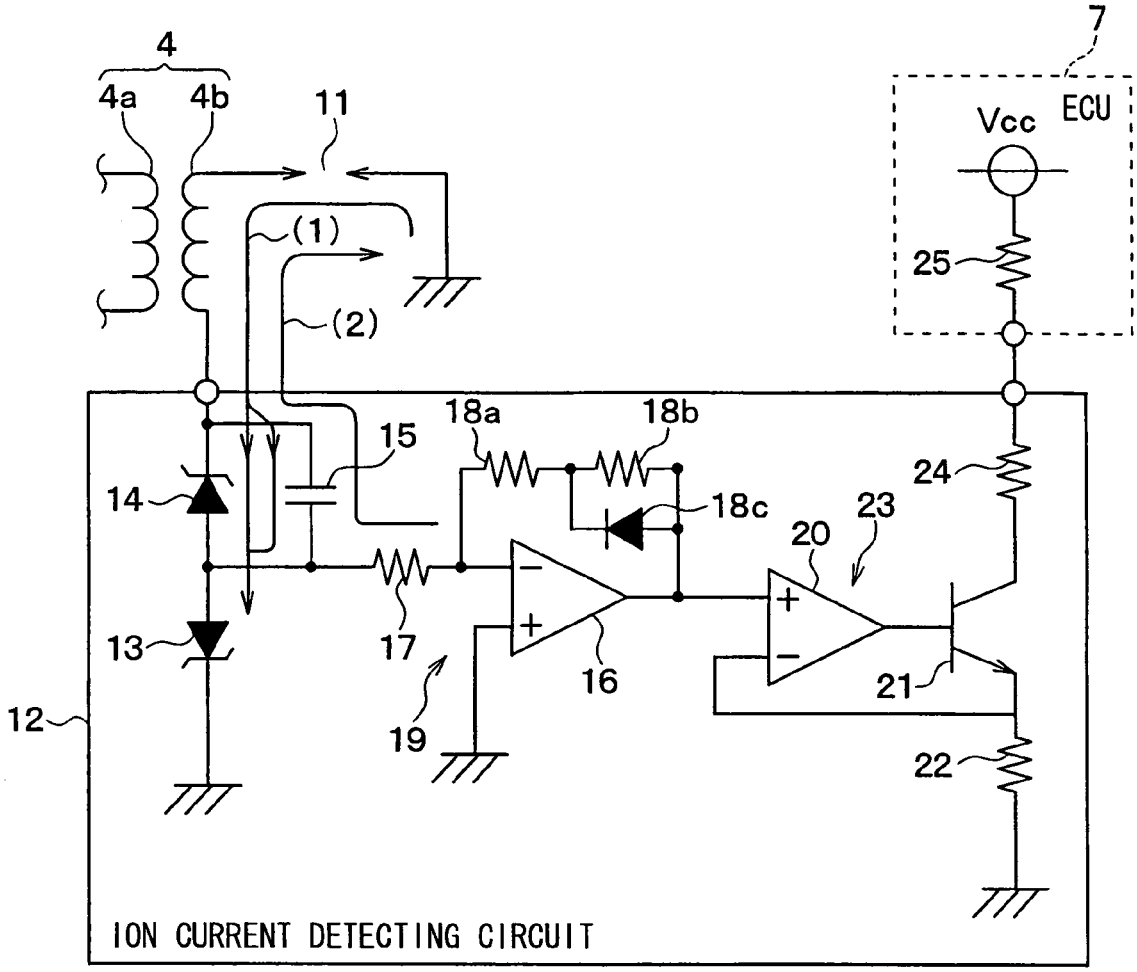
FIG. 4 is a detailed circuit diagram of the ion current detecting device of FIG. 2.

FIG. 4 is a circuit diagram showing the example of such a nonlinear element 18. As shown in FIG. 4, for example, the nonlinear element 18 can be constituted resistances 18*a* and 18*b* which are connected in series with each other, and a diode 18*c* which is connected in parallel with the resistance 18*b*.

In such a circuit, a current continues to flow into the resistance 18*a* and 18*b* before a current begins to flow to the diode 18*c*, i.e., before both ends voltage of the resistance 18*b* reaches to a forward direction voltage of PN junction which constitutes the diode 18*c*. Therefore, in case the ion current is minute because of spark plug malfunction (for example, fouling of the spark plug) the amplification rate of the amplifier circuit 19 becomes larger because the amplification rate is determined by combined resistance of the resistances 18*a* and 18*b*.

On the other hand, when a current comes to flow into the diode 18*c*, a current seldom flows through the resistance 18*b* but almost all current flows through the diode 18*c*. Thus, when ion current is higher to some extent, the amplification rate of the amplifier circuit 19 is determined by the resistance 18*a* and becomes smaller.

Figure 5:
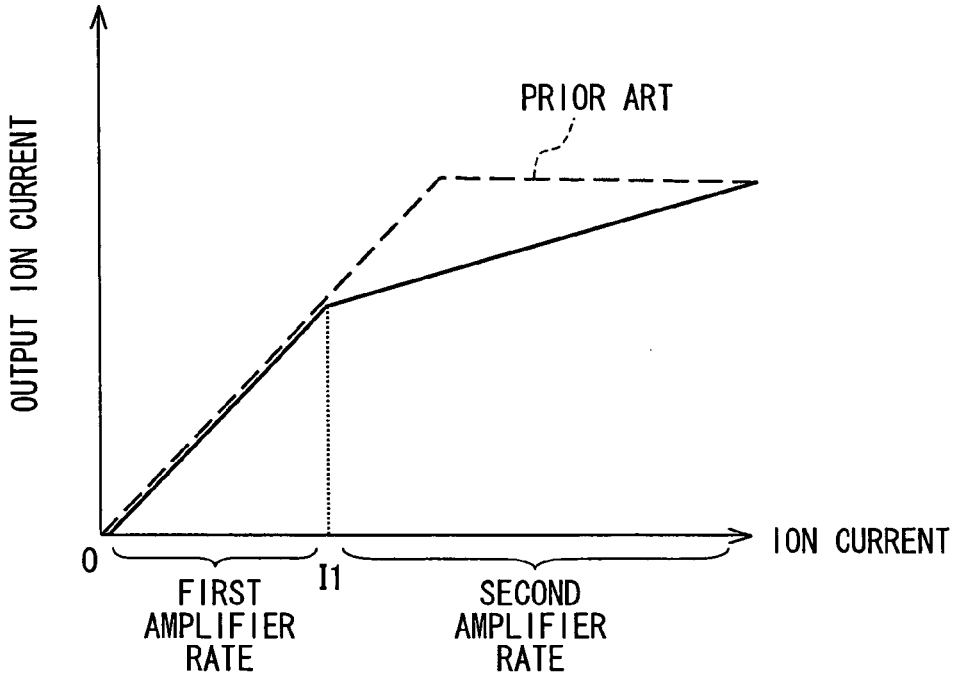
FIG. 5 is a figure showing ion current-output ion current characteristics of FIG. 4 and FIG. 8.
Figure 8:
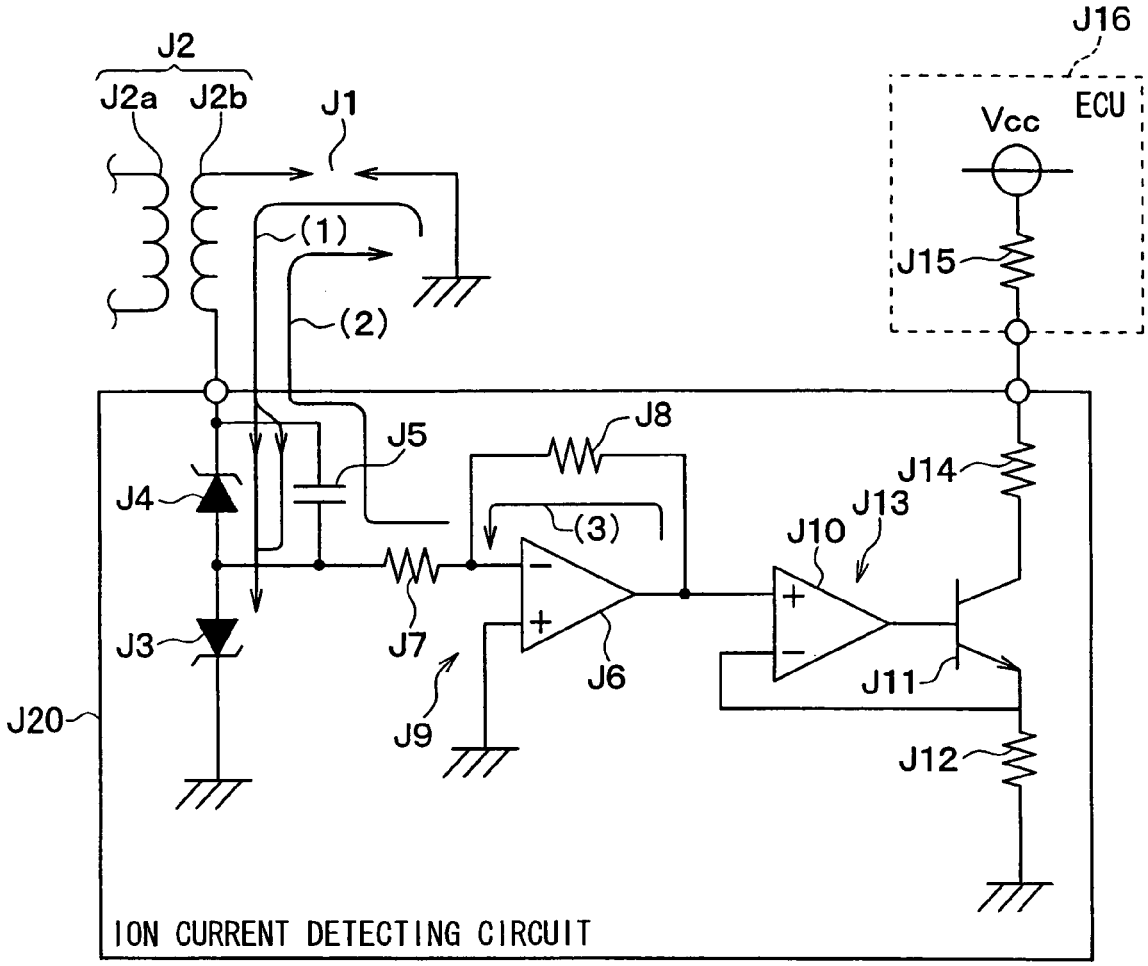
FIG. 8 PRIOR ART
FIG. 8.

FIG. 5 shows an ion current-ion output current characteristics of FIG. 4 and FIG. 8. The ion current-ion output current characteristic of FIG. 4 (example embodiment) is indicated by the solid line, and the ion current-ion output current characteristic of FIG. 8 (prior art) is indicated by the dashed line. As shown in FIG. 5, a first increase slope (namely, a first amplification rate) of ion output current is larger when the ion current is lower than a predetermined current level I1, and a second increase slope (namely, a second amplification rate) of ion output current is smaller than the first increase slope when the ion current becomes higher than the predetermined current level I1, by using the nonlinear element 18 in FIG. 4 (see the solid line in FIG. 5). In other words, the second amplification rate is smaller than the first amplification rate.

As described above, the amplifier circuit 19 of the example embodiment can change the amplifier rate according to ion current inputted into the ion current detecting circuit 12 so that an output ion current from the ion current detecting circuit 12 becomes nonlinear relative to the ion current inputted. Thus the amplification rate becomes larger even when ion current is minute because of spark plug malfunction (for example, fouling of the spark plug), and the amplification rate becomes smaller when the ion current is detected at a usual level (higher than at the malfunction of the spark plug).

Therefore, a minute ion current is detectable by using a large amplification rate at the time of spark plug malfunction. Further, the amplification rate becomes smaller and it is possible to also amplify a higher ion current correctly if the ion current becomes higher.

Other example embodiment will now be explained bellows. The amplifier circuit 19 may be constructed by other elements, though the amplifier circuit 19 of above described example embodiment is used the resistances 18*a* and 18*b* and the diode 18*c* in order to change the amplification rate of the ion current detecting circuit 12 according to ion current. In short, any form of circuit can be used as the nonlinear element 18 as long as that circuit provides an amplification rate which becomes larger when the ion current is minute (e.g., malfunction of the spark plug (for example, fouling of the spark plug), etc.) , and an amplification rate which becomes smaller when the usual ion current is used.

Figure 6:
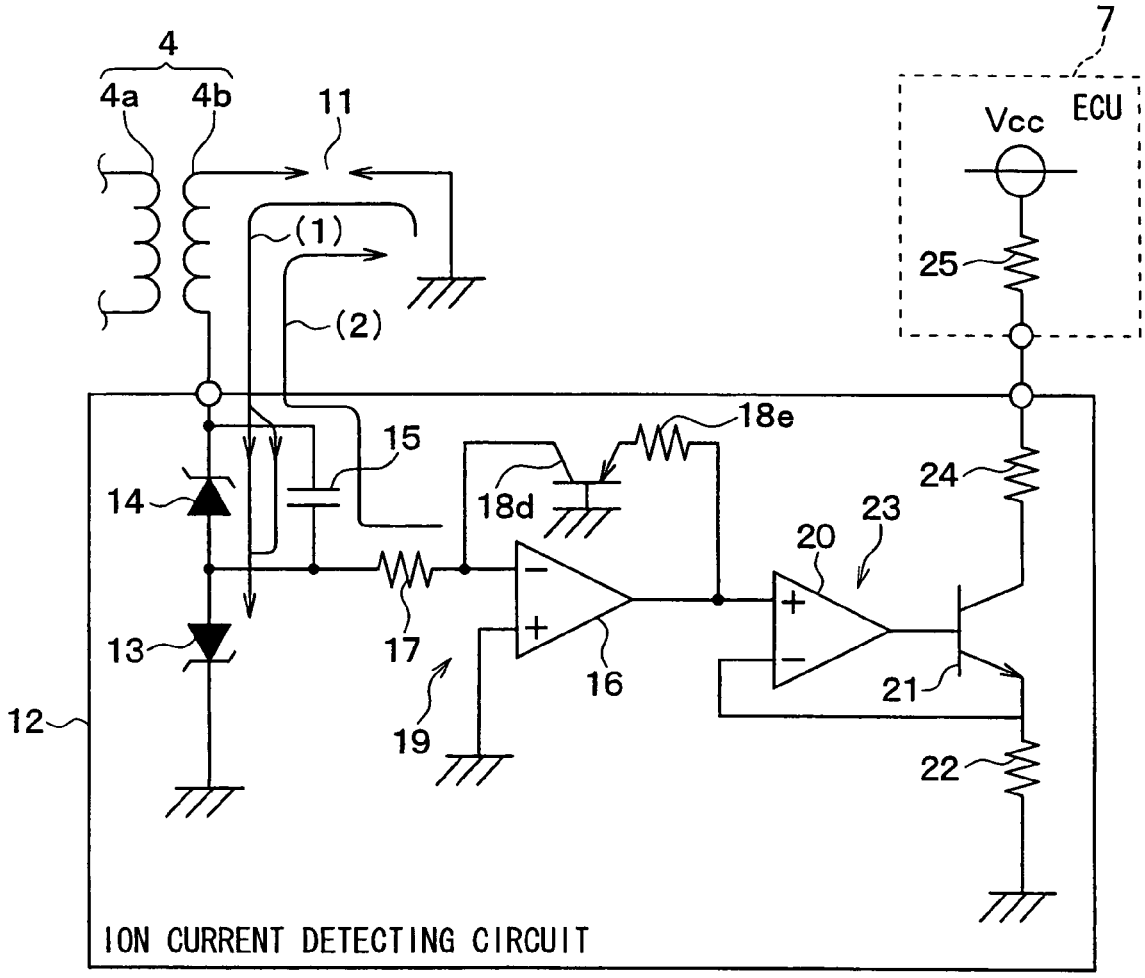
FIG. 6 is a detailed circuit diagram of an ion current detecting device according to another example embodiment of the invention.

A nonlinear element 18 constituted by other elements in accordance with another example embodiment is shown in FIG. 6. As shown in FIG. 6, the nonlinear element 18 includes a pnp transistor 18*d* and a gain adjusting resistance 18*e* for gain adjustment. Specifically, a collector of the pnp transistor 18*e* is connected to the inverting input terminal of the operational amplifier 16, an emitter of the pnp transistor 18*e* is connected to the output terminal of the operational amplifier 16 through the resistance 18*e*, and a base of the pnp transistor 18*e* is connected to ground (GND).

When a voltage between the base and the emitter of the pnp transistor 18*d* is under Vf (forward direction voltage), the pnp transistor 18*d* is turned off, but when the voltage between the base and the emitter of the pnp transistor 18*d* becomes more than Vf, the PNP transistor 18*d* is turned on. At this time, a current value which flows through the PNP transistor 18*d* changes in logarithm near the Vf.

Figure 7:
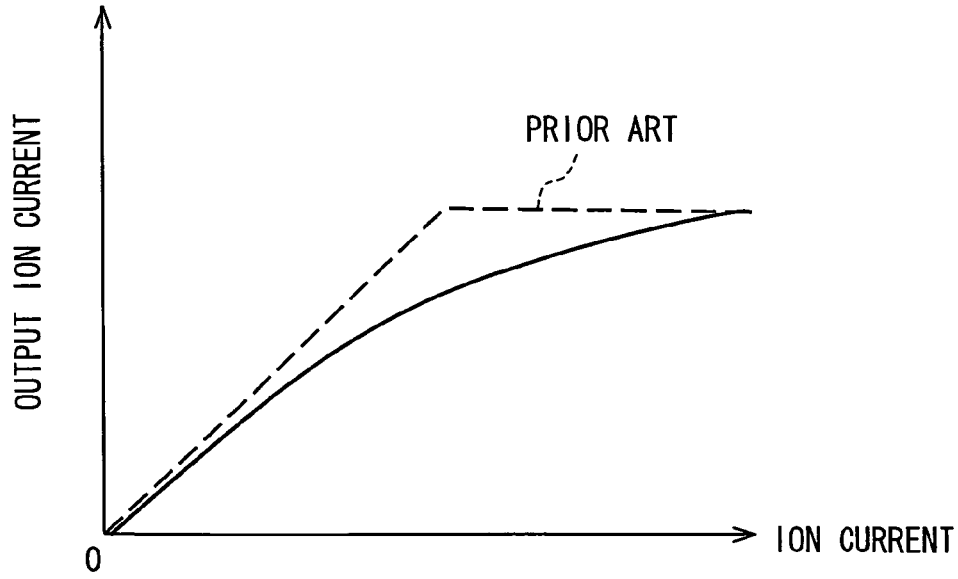
FIG. 7 is a figure showing ion current-output ion current characteristics of FIG. 6.

FIG. 7 shows an ion current-ion output current characteristics of FIG. 6 and FIG. 8. The ion current-ion output current characteristic of FIG. 4 (example embodiment) is indicated by the solid line, and the ion current-ion output current characteristic of FIG. 8 (prior art) is indicated by the dashed line. As shown in FIG. 7, the ion output current logarithmically increases according to ion current, by using the nonlinear element 18 in FIG. 6.

Therefore, a minute ion current is detectable by setting a larger amplification rate at the time of spark plug malfunction (for example, a fouling of electrodes of the spark plug). Further, the amplification rate becomes smaller and it is thus possible to also amplify a higher ion current correctly if the ion current becomes higher.

Moreover, although the inverting type is used as the operational amplifier 16 of the amplifier circuit 19 in the above described example embodiments, this is also a mere example and a non-inverting type may alternatively be used as the operational amplifier 16 of the amplifier circuit 19.

The present invention should not be limited to the disclosed example embodiments, but may be implemented in other ways without departing from the spirit of the aspect.

What is claimed is:

1. An ion current detecting device for detecting an ignition condition in an internal combustion engine comprising:

a spark plug for generating a spark in a combustion chamber of the internal combustion engine and having a gap between electrodes;

an ignition coil for supplying high voltage to the spark plug; and an ion current detecting unit for detecting ion current based on combustion ions generated after an ignition which is performed in the combustion chamber of the internal combustion engine, and the ion current detecting unit being electrically connected to the spark plug and the ignition coil, and including an amplifier unit for amplifying ion current detected by the ion current detecting unit, wherein an amplification rate of the amplifier unit has a first amplification rate for a small ion current level and a second amplification rate for a high ion current level, the amplifier unit sets that the second amplification rate to a lower level than the first amplification rate so that the amplified ion current output from the amplifier unit increases with an increase in the ion current value.

2. The ion current detecting device according to claim 1, wherein the amplifier unit sets the first amplification rate when the ion current detected by the ion current detecting device is smaller than a predetermined level and the second amplification rate when the ion current detected by the ion current detecting device is larger than the predetermined level.

3. An ion current detecting device for detecting an ignition condition in an internal combustion engine comprising:

a spark plug for generating a spark in a combustion chamber of the internal combustion engine and having a gap between electrodes;

an ignition coil for supplying high voltage to the spark plug; and an ion current detecting unit for detecting ion current based on combustion ions generated after an ignition which is performed in the combustion chamber of the internal combustion engine, the ion current detecting unit being electrically connected to the spark plug and the ignition coil, and including an amplifier unit for amplifying ion current detected by the ion current detecting unit, an amplification rate of the amplifier unit being set so that an amplified ion current output from the amplifier unit varies nonlinearly with the ion current detected by the ion current detecting unit;

wherein the ion current detecting unit further includes a Zener diode;

a capacitor connected in parallel with the Zener diode so that a secondary coil of the ignition coil connected in series with the Zener diode and the capacitor;

an amplifier circuit which amplifies the ion current detected by the ion current detecting unit, is connected with the Zener diode and the capacitor, and includes a nonlinear unit which sets the amplification rate of ion current.

4. The ion current detecting device according to claim 3, wherein the amplifier circuit includes:

an operational amplifier, a resistance, and the nonlinear unit, an inverting input terminal of the operational amplifier is connected with the Zener diode and the capacitor through the resistance, a non-inverting input terminal of the operational amplifier is connected to ground, and the nonlinear unit is connected between an output terminal of the operational amplifier and the inverting input terminal of the operational amplifier.

5. The ion current detecting device according to claim 4, wherein the nonlinear unit includes a first resistance, a second resistance, and a diode, the first resistance is connected in series with the second resistance, and the diode is connected in parallel with the second resistance.

6. The ion current detecting device according to claim 4, wherein the nonlinear unit has a pnp transistor and a gain adjusting resistance, a collector of the pnp transistor is connected to the inverting input terminal of the operational amplifier, an emitter of the pnp transistor is connected to the non-inverting input terminal of the operational amplifier through the gain adjusting resistance, and an base of the pnp transistor is connected to ground, the amplification rate of the amplifier unit is set so that the amplified ion current output from the amplifier unit varies logarithmically with the detected ion current.

* * * * *